United States Patent [19]

Skegin

[11] Patent Number: 4,833,579

[45] Date of Patent: May 23, 1989

[54] EXTRUDED LAMP FIXTURES FOR HALOGEN LIGHT SOURCES

[76] Inventor: Maer Skegin, 1411 N. Poinsetta Pl., #206, Los Angeles, Calif. 90046

[21] Appl. No.: 165,722

[22] Filed: Mar. 9, 1988

[51] Int. Cl.[4] ..... F21V 17/00

[52] U.S. Cl. ..... 362/362; 362/293; 362/287; 362/371

[58] Field of Search ..... 362/147, 148, 150, 285, 362/287, 269, 275, 368, 370, 371, 263, 293, 296, 374, 375, 362, 418, 419, 427, 430

[56] References Cited

U.S. PATENT DOCUMENTS

| | | | |
|---|---|---|---|
| 3,305,681 | 2/1967 | Green | 362/275 |
| 4,232,359 | 11/1980 | Leon et al. | 362/285 |
| 4,310,875 | 1/1982 | Price | 362/269 |
| 4,414,617 | 11/1983 | Galindo | 362/150 |
| 4,430,695 | 2/1984 | Payne et al. | 362/293 |
| 4,600,972 | 7/1986 | MacIntyre | 362/269 |

FOREIGN PATENT DOCUMENTS

| | | | |
|---|---|---|---|
| 0043528 | 11/1982 | European Pat. Off. | 362/269 |
| 2046892 | 11/1980 | United Kingdom | 362/287 |

*Primary Examiner*—Ira S. Lazarus
*Assistant Examiner*—D. M. Cox
*Attorney, Agent, or Firm*—Natan Epstein

[57] ABSTRACT

A housing for miniature halogen lamps is assembled from extruded tubular segments by means of a coupler tube fixed to one segment and frictionally insertable into the other segment which carries a track swivel mount and a lamp socket connected to electrical supply wires. The socket carries a reflector which is closely received and supported within the coupler tube and is easily accessible upon separation of the segments.

23 Claims, 3 Drawing Sheets

EXTRUDED LAMP FIXTURES FOR HALOGEN LIGHT SOURCES

BACKGROUND OF THE INVENTION

1. Field of the Invention

The present invention is directed to the field of interior lighting fixtures and in particular relates to housings or fixtures for use with compact high intensity light sources.

2. State of the Prior Art

The current trend in interior lighting is away from the decades old, relatively bulky light bulbs using tungsten filaments in vacuum to more compact and efficient, brighter halogen light sources. The new halogen lamp bulbs are quite small in comparison and are suitable for use with small reflectors which greatly assist in directing the emitted light in a useful manner so that the most effective use can be made of the available light output. The high intensity halogen light sources are widely available in a series of standard sizes, configurations and power handling capabilities. A continuing need exists for lamp housings and fixtures particularly adapted to these new light sources. The need is for compact, even miniature housings of simple construction and easy assembly consistent with safe and reliable operation, especially fixtures for track mounting. Quality track light type fixtures currently on the market are costly and a particular need exists for attractive, durable miniature tract light housings of lower cost.

SUMMARY OF THE INVENTION

The novel light fixture comprises a tubular housing comprised of at least two tubular segments including a main housing segment to which is affixed a fixture mount, and a baffle holder segment. The two segments are axially coupled by a baffle tube which has a portion fixed within the baffle holder segment and a portion which extends into and makes a friction fit within the main housing segment. A lamp socket is electrically connected to electric power conductors within the main housing segment associated with the fixture mounting, and a halogen lamp/reflector assembly is removably and operatively mounted in the socket. The reflector has a circular rim which is received within the baffle tube and held by the same against lateral movement. In one embodiment the lamp socket is mounted to one end of a spacer, the opposite end of the spacer being affixed to a panel closing the rear end of the main housing segment. The spacer extends axially through the main housing segment so that the reflector rim lies outside the front end of the tube segment. When the tube segments are then joined axially by means of the aforementioned internal coupler tube inserted into the front end of the main housing section, the reflector rim is received within the coupler tube and closely held therein against lateral movement at the forward end of the bushing.

In another embodiment, the socket is mounted by means of a spring mounting clip engaged to the baffle tube. The reflector rim is closely held within the baffle tube against movement and the socket together with the lamp/reflector assembly are easily removable by manually disengaging the spring clip from the baffle tube after the two housing segments have been separated.

The lamp housings of the fixtures of this invention can be made simply by cutting a length of tubing into two segments. For this purpose, it is particularly advantageous to make the tubing by continuous extrusion so that tubing of many different external cross sections and dimensions can be easily extruded, with or without decorative detail such as longitudinal striping, grooves, reliefs, etc..

The lamp fixtures of this invention are characterized in that great flexibility is offered to the interior designer with a modest investment in inventory. Many different ornamental combinations and visual variations can be easily and inexpensively achieved with the lamp fixtures disclosed herein, by interchanging the styles, sizes, shapes, colors and finishes of the housing tube and baffle segment of a particular fixture. Still more variations may be achieved by placing a third tubing segment on the coupler tube between the baffle segment and the housing segment. This third segment, preferably also an extrusion, may be of contrasting color, finish, shape, or other characteristic to the other two two segments in a manner limited only by the imagination of the designer. Thus with only a few extrusion cross-sections, a considerable variety of fixtures of original appearance can be assembled.

Various light control modules may be fitted to the front of the lamp housing. These optional modules are tubular segments carrying one or more light control elements including but not limited to light color filters, polarizers, adjustable iris diaphragms, optical lenses and condensers for achieving a spotlight effect, and "barn door" units for adjustably limiting the illumination spread of the fixture. The tubular segments of these modules may also be extrusion segments cut from the same extrusion as the main housing and baffle holder segments and may be assembled to the baffle holder segment by means of another internal coupler tube in a friction fit, so that the complete fixture has a pleasing streamlined appearance notwithstanding its segmented construction.

DETAILED DESCRIPTION OF THE PREFERRED EMBODIMENTS

Figure 1:
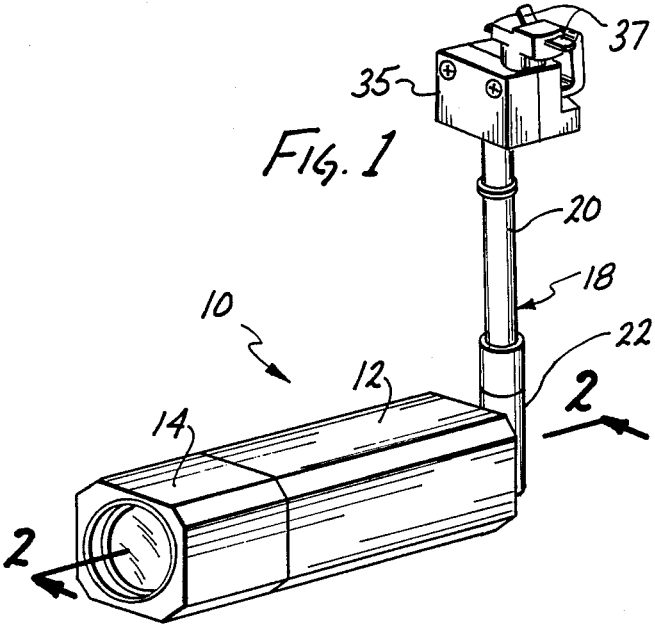
FIG. 1 is a perspective view of a first typical miniature lamp housing constructed according to this invention.
Figure 2:
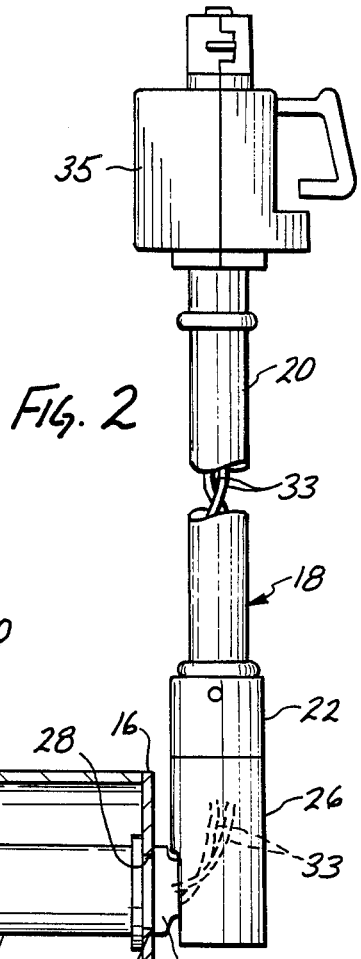
FIG. 2 is a longitudinal cross-section taken in elevation of the fixture of FIG. 1.

With reference to the drawings, FIG. 1 shows a lamp fixture 10 which includes a tubular main housing segment 12, a baffle holder segment 14 attached to the forward end of the tubular body 12 and a rear end panel 16 closing the opposite, rear end of the main housing segment 12, as best seen in the longitudinal section of FIG. 2. A fixture mounting 18 comprises a hollow rod 20 fixed to a swivel assembly 22 rotatable about the axis of rod 20 in the horizontal plane of FIG. 2. In turn, the swivel assembly 22 includes a threaded stub 24 pivoted to the body 26 for 90 degree movement in the vertical plane of the FIG. 2 drawings, between the illustrated right angle relationship between the rod 20 and lamp body 12 to a in-line position where the housing segment 12 is axially aligned with the mounting rod 20. The stub 24 is inserted through an opening 28 in the rear panel 16 and is threaded into a hollow spacer bushing 30, so that the rear panel 16 is tightly held in an interference fit between a shoulder 29 on the stub 24 and the rear end of the spacer 30. A lamp socket 32 is mounted at the free forward end of the spacer 30 and electrical conductors 34 are threaded from the socket 32 through the mounting rod 20, swivel body 26, threaded stub 24 and spacer bushing 30 for supplying electrical power from a suitable source of electrical power. The upper end of the mounting rod 20 may carry a standard track-light connector 35 adapted to slide along a conventional light track mounted to a ceiling or wall, with electrically conductive wiper contacts which draw electrical power from the track to the conductors 33. The swivel rod 20 may also be attached to a suitable supporting surface by means of a conventional canopy mount which in turn is mounted over an electrical outlet in a wall or ceiling surface, as is well known in the trade.

The main housing segment 12 is a tubular extrusion characterized by a cylindrical axial bore 34 and an outer cross-section which may be of any esthetically desirable shape, such as the soft-square cross section shown in the drawings. The baffle holder segment 14 is a shorter length of the same extrusion as that of segment 12, thus having the same inner and outer cross-sections and in particular, an axial bore 34 continuous with the axial bore 34 in the main section 12. The baffle holder 14 is attached to the forward end of the segment 12 by means of a baffle tube 36 with an outer diameter closely fitted to the diameter of extrusion bore 34, so that the baffle tube makes a snug sliding friction fit into the housing segment 12 as a bridging element connecting the baffle holder segment 14 to the main segment 12 as seen in FIG. 2. Preferably, the connecting baffle tube 36 is permanently fixed, as by means of an adhesive, to the baffle holder segment 14. The exposed portion 42 of the connecting tube 36 which extends rearwardly of the baffle holder 14 then fits into the forward end of the lamp tube bore 34 in a close-tolerance slide fit and is frictionally retained therein.

Figure 3:
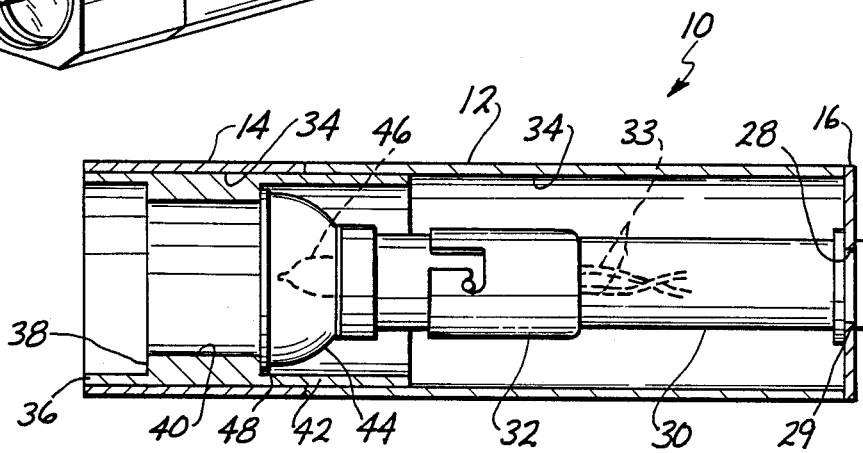
FIG. 3 is a front end view of the fixture of FIG. 1.
Figure 3:
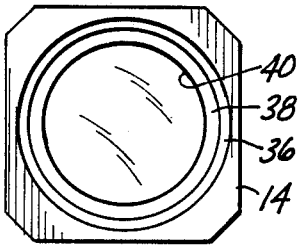

A commercially available light reflector 44 / halogen high intensity incandescent miniature lamp 46 assembly is fitted to the socket 32 as shown in FIGS. 2 and 3. The reflector 44 has a circular rim 48 having a diameter slightly lesser than the inside diameter of the coupler tube portion 42, such that the reflector rim 48 slides into and is closely received within the baffle tube 36 when the same is fitted into the axial bore of the main housing segment 12. The reflector 44 and consequently the lamp socket 32 are thus held and supported within the coupler tube against lateral or radial movement within the housing segment 12 by virtue of the aforementioned close fit.

The coupler tube 36 is of constant external diameter but contains a fixed baffle 38 positioned immediately forward of the reflector rim 48 and defining a baffle aperture 40 of diameter smaller than the diameter of reflector rim 48 so as to hide the rim 48 from view and corresponding to the effective reflecting surface of the reflector 44. The baffle 38 may be machined integrally with the wall of a tube 36 or may be a separate element secured within the tube 36. The coupler tube 36 simplifies the construction and assembly of the light fixture by serving the multiple functions of axially joining the extrusion segments 12 and 14, supporting the reflector 44/lamp 46/socket 32 assembly against lateral movement such that the spacer bushing 30 is held securely at both of its ends, and holding the light baffle 38 in front of the reflector.

The combined axial length of the spacer bushing 30, lamp socket 32 and lamp/reflector 44 is such that the reflector rim 48 lies exteriorly of the forward end of the main housing segment 12 as best understood from FIG. 2. After separation of the baffle holder 14 the reflector rim 48 is exposed and can be easily grasped to allow removal and exchange of the lamp 46 whenever necessary. This is accomplished by pulling axially on the baffle holder 14 until the coupler tube portion 42 is withdrawn and separates from the tubular body 12. The exposed reflector rim 48 projecting from the end of the housing tube 12 can be slightly pushed in and turned so as to disengage the reflector 44 and/or lamp 46 from the socket 32, and a replacement lamp inserted in its place, after which the baffle holder 14 is replaced by inserting the coupler tube portion 42 into the open forward end of the main housing bore 34 and over the reflector rim 48.

Figure 4:
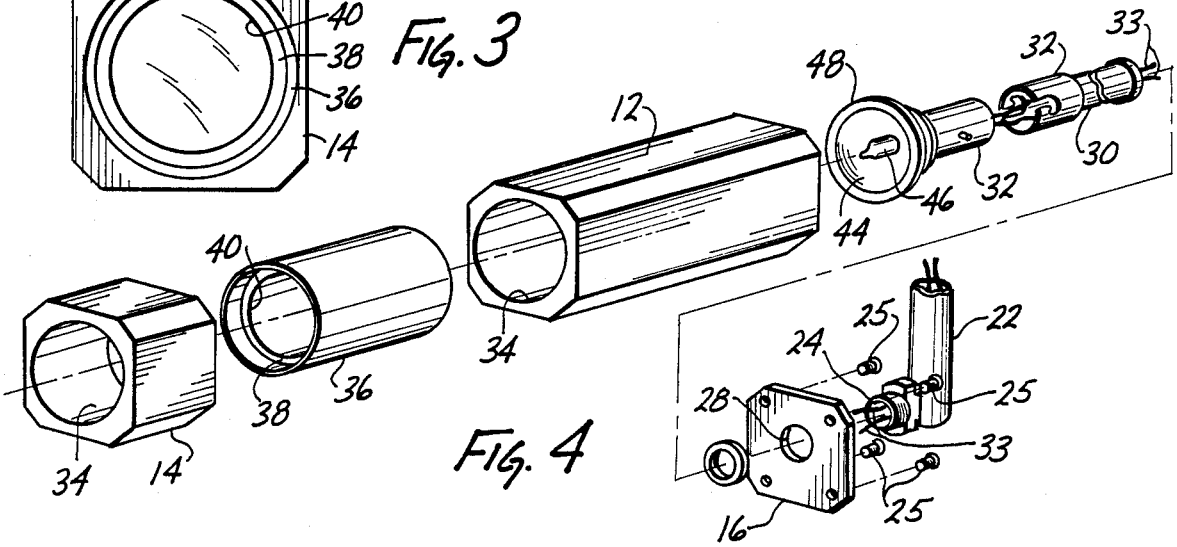
FIG. 4 is an axially exploded view of the fixture of FIG. 1.

Assembly of the light fixture 10 is further facilitated because the mounting swivel (or other external mounting device) can be first assembled to the rear panel 16, the spacer tube 30, and lamp socket 32 to make a prewired subassembly which can be subsequently assembled to the main housing segment 12 simply by means of the four screws 25 passing through corresponding holes 27 in plate 16 and threaded into corresponding axially oriented holes in the rear of segment 12 as indicated in FIG. 4, so that the spacer 30 is axially fixed in bore 34 of the housing segment 12. The aforementioned prewired subassemblies can be kept in inventory by the retailer who can then custom assemble fixtures for each customer. The same sub-assembly can be used with main housing extrusion segments of different ornamental finish and cross-section thereby minimizing the number of parts and the number of steps necessary to assemble an inventory of assorted fixtures, even at the retail level.

Figure 8:
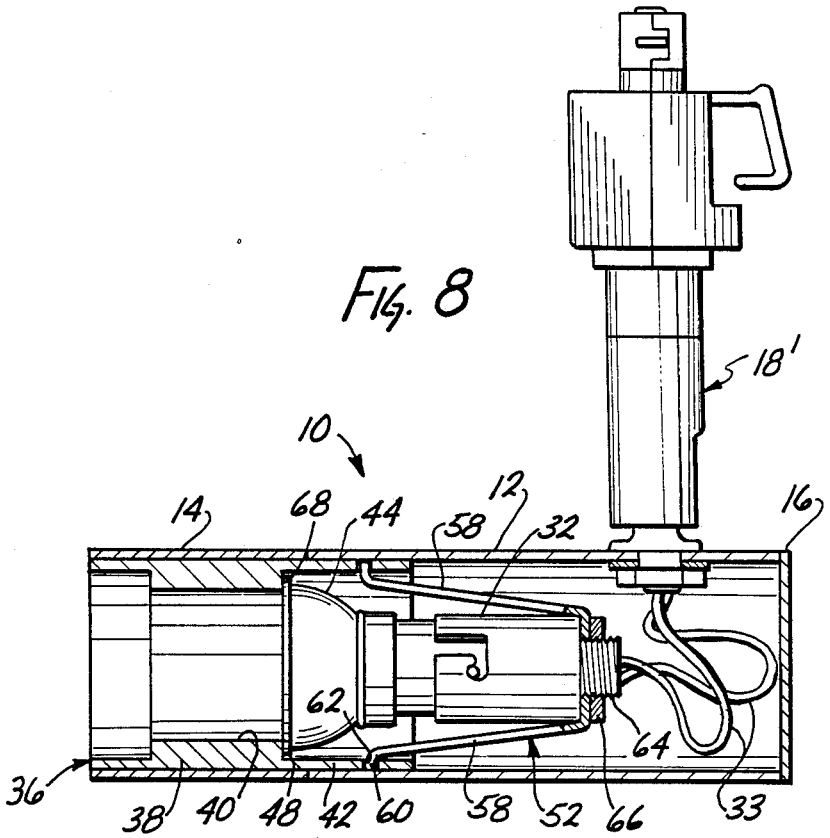
FIG. 8 is a longitudinal section of a light fixture showing an alternate socket mounting arrangement.
Figure 9:
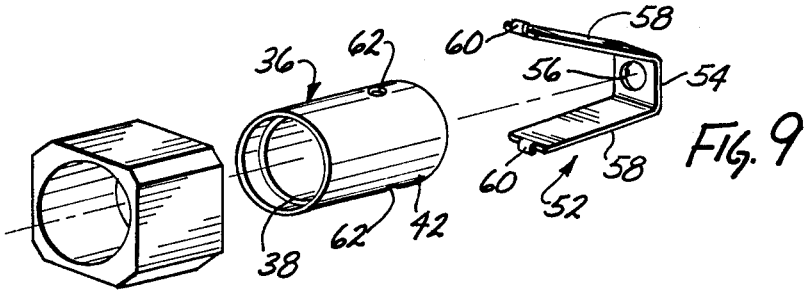
FIG. 9 is an axially exploded perspective illustration of the snap-in mounting clip arrangement of FIG. 8.

As an alternative to the socket spacer 30, FIG. 8 shows the lamp socket 32 secured to the baffle tube 36 by means of a mounting U-clip 52, which is more fully seen in FIG. 9. The mounting clip 52 includes a central section 54 in which is a hole 56 between two somewhat divergent legs 58. The clip 52 is of resilient material such that the ends of the legs 58 may be squeezed together for insertion into the portion 42 of the coupler tube 36. Each leg 58 carries an end tab 60, each of which fits into a corresponding one of two diametrically opposed holes 62 in the baffle tube 36 when the clip is released and the legs 58 spread apart under inherent spring tension. The lamp socket 32 has a threaded rear stub 64 which passes through the hole 56 in the mounting clip and engages a retaining nut 66. The mounting clip 52 is dimensioned so as to hold the reflector 44 with its rim 48 against the inner shoulder 68 of the baffle 38. This shoulder is the transition between the reduced baffle aperture 40 and the larger inner diameter of baffle tube section 42. The mounting clip 52 maintains the reflector rim securely seated against the shoulder 68 and the reflector rim 48 is further held against radial movement by the wall portion 42 of the baffle tube. Access to the lamp 46 and reflector 44 in the FIG. 8 arrangement is as convenient as that in previously described embodiments. The baffle holder segment 14 is pulled axially off the end of the main housing segment 12 carrying with it the socket 32 which however remains connected to conductors 33 which are threaded through external mount 18' in a manner described with FIGS. 2 and 6. The clip 52 is readily separated from the baffle holder segment 14 by squeezing together the legs 58 to withdraw the tabs 60 from baffle tube hole 62, and then removing the reflector and socket assembly from the baffle tube 36.

Figure 10:
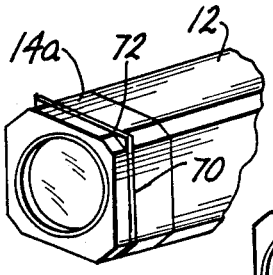
FIG. 10 shows in perspective a fixture provided with a light filter holder.
Figure 11:
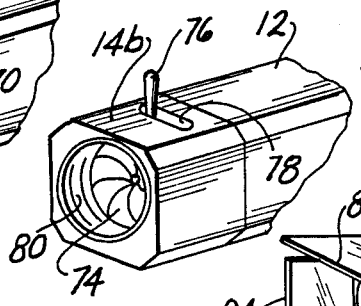
FIG. 11 shows in perspective view a light fixture provided with an iris diaphragm and spotlight module.
Figure 12:
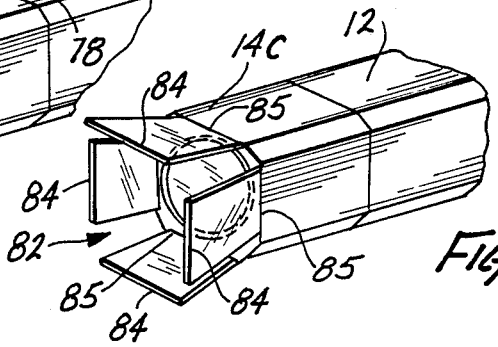
FIG. 12 shows a light fixture provided with a barn door arrangement.

Various lighting control features, illustrated in FIGS. 10 through 12, may be added to the previously described fixtures of this invention. In FIG. 10, the baffle holder segment **14*a* has been slotted in an axially transverse plane through the full diameter of the baffle aperture 40 but stopping short of cutting completely through the extrusion. The slot 70 thus formed permits insertion of a color gel filter sheet 72 in front of the reflector 44 so as to give the light emitted by the fixture any desired color. In addition to color filters other optical elements such as polaroid sheets, ultraviolet or infrared filters, etc., may be inserted in the slot 70 of the holder segment 14*a*. The slotted baffle holder segment 14*a* is thus a filter module and provides an easy, convenient and inexpensive means of holding a wide variety of low cost filters which may consist merely of sheet material cut to an appropriate size and shape for insertion into the filter holder slot 70**. No particular brackets, frames or other retaining elements are needed for the filter materials.

FIG. 11 shows a fixture constructed according to any of FIGS. 1 through 9 wherein the baffle holder segment **14*b* has been provided with an iris diaphragm 74. The diaphragm is mounted within the bore 34 of the baffle holder segment in lieu of baffle 38 by any convenient means as for example between two tube sections adhesively fixed within the bore 34 of baffle segment 14*b* on each side of the iris 74 so as to hold the latter axially in place. The iris is of a commercially available type used in light projectors and the like and includes an iris control lever 76 which extends through a slot 78 machined in the holder segment 14*b*, allowing the aperture of the iris 74 to be manually adjusted by sliding the lever 76 between the two ends of the slot 78. The iris 74 is typically placed at one focal point of a focusing lens 80 mounted within the bore 34 of the segment 14*b* ahead of the iris 74 such than an image of the iris aperture is projected by the fixture and a well defined circular spotlight effect is obtained. The segment 14*b* provided with iris 74 and lens 80 is thus a spotlight module readily interchangeable with a filter holder segment 14*a* of FIG. 10 or the baffle holder segment 14 of FIGS. 1 through 9**.

FIG. 12 shows a barn door module comprised of holder segment **14*c* provided with a so-called barn door arrangement 82 which includes four trapezoidal shades 84 hinged to the front end of the extrusion segment 14*c* along each of the four sides 85 of the segment end. Each shade 84** may be independently adjusted so as to limit the light projected by the fixture to a particular area to be illuminated.

Each of the holder segments or modules **14*a*, 14*b* and 14*c* in FIGS. 10 through 12 includes a coupler tube segment equivalent to tube segment 42 in FIGS. 1 through 9 which allows the various modules to be interchangeably fitted to the front end of the main housing segment 12 while at the same time receiving and holding the reflector/lamp assembly 42 within the coupler tube in a manner earlier described. It is also within the scope of this invention to provide for stackable holder segments whereby, for example, a spotlight module 14*b* may be fitted onto the front end of a filter segment 14*a*, or a barn door holder segment 14*c* fitted over a filter segment 14*a*. The stacking of the holder segments is by means of the coupler tube segment 42 extending from the rear of one holder segment 14 and fitting into the front end of the other holder segment 14**.

The main housing segment 12 and baffle holder segment 14 are preferably made of extruded aluminum for a lightweight but durable fixture housing 10 which can readily take on a variety of electroplated or otherwise applied finishes.

The ornamental appearance of the light fixture can be easily varied to suit different tastes and interior decors. The exterior surfaces of the main housing segment 12 and the baffle holder segment 14 can be finished in a variety of available metal finishes including flat black, chrome, bronze, etc., with complementary or contrasting exterior finishes, colors or textures between the two segments 12 and 14. Of particular interest to interior decorators is the flexibility inherently provided by the easy interchangeability of the baffle holder 14. For example, the baffle holder 14 can have a black exterior finish while the tube body 12 is chrome plated (or vice-versa) for an attractive contrast between the two. The appearance of each fixture may be readily changed and adapted to particular tastes and requirements merely by interchanging differently finished baffle holders 14, even after the fixture has been installed, quickly and easily by merely pulling off an existing baffle holder and inserting a new one without use of any tools or special skills.

Figure 5:
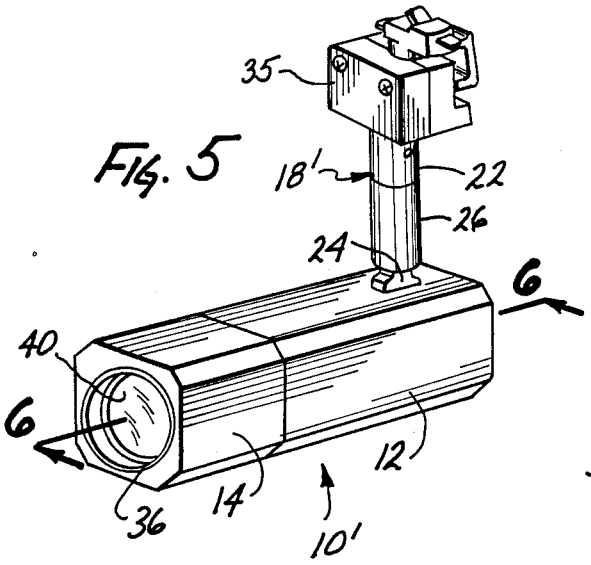
FIG. 5 is a perspective view of a variation of the miniature lamp housing of FIG. 1.
Figure 6:
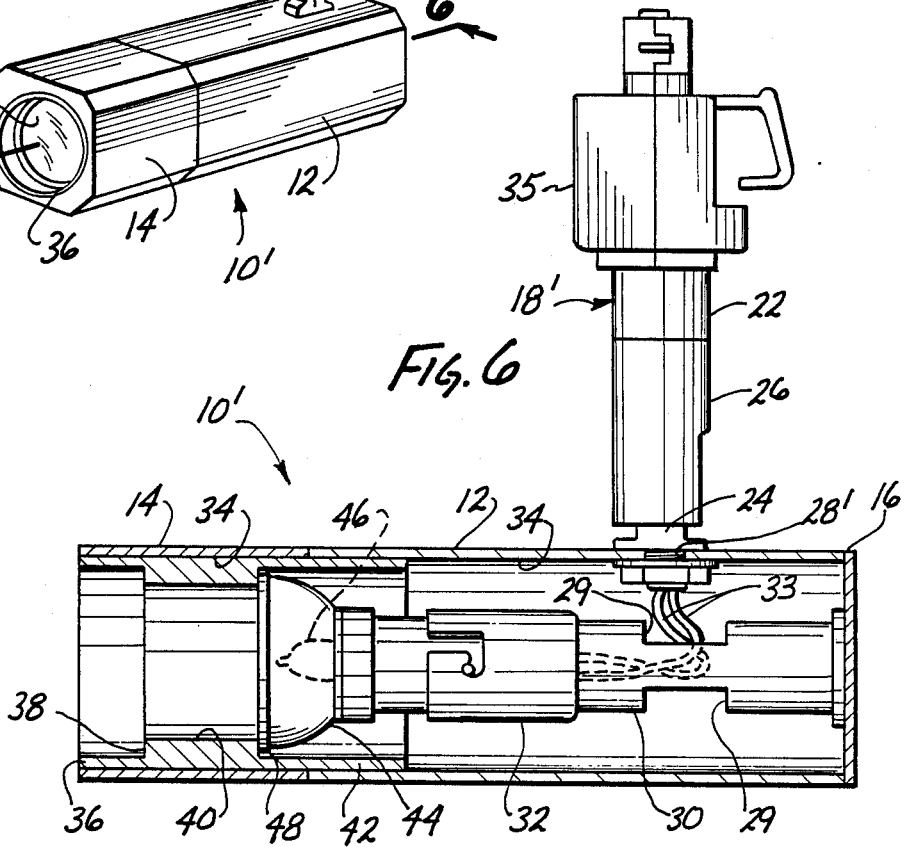
FIG. 6 is longitudinal section taken in elevation of the variation of FIG. 5.

If desired, a mounting unit 18' can be attached to the main housing segment 12 at an intermediate point as shown in the modified fixture 10' of FIGS. 5 and 6, rather than at the rear end of the segment 12. In such modification, the threaded stub 24 of the mounting 18' is secured through a hole 28' in one of the side surfaces of the segment 12, allowing both vertical and horizontal pivoting of the lamp housing. The rear end of the hollow spacer 30 is fixed to the rear panel 16 by a suitable fastener and one or more openings 29 un the wall of the tube 30 are provided in the spacer 30 to admit the conductors 33 as shown.

Figure 7:
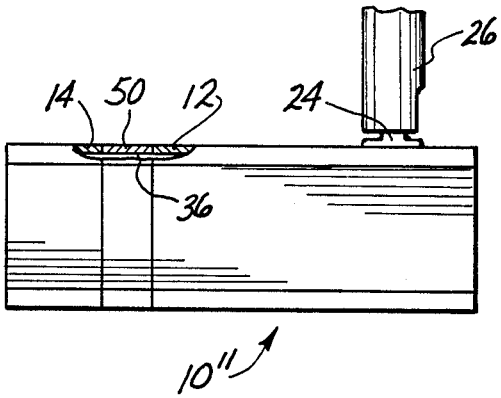
FIG. 7 is a view in side elevation of a third lamp housing according to this invention.

For further ornamental variety, a third, intermediate extrusion segment 50 shown in FIG. 7 may be fitted over the coupler tube section 42 axially intermediate the baffle holder 14 and main housing tube 12. In this case, the exposed length 42 of the coupler tube is made sufficiently longer than the intermediate extrusion segment 50 so as to make a secure friction fit when inserted into the bore 34 of the main housing segment. The addition of an intermediate segment 50 allows for a greater number of color and finish combinations as between the three extrusion segments 12, 14 and 50 which comprise the housing 10". By way of example, the baffle holder 14 and main housing segment 12 may be chrome plated while the intermediate segment 50 is a contrasting black finish. Many other such decorative combinations will readily come to mind. Still more variations in appearance can be had by varying the outer dimensions and cross-sectional shapes of the various segments while maintaining a common diameter of the extrusion bore 34 in each segment 12, 14 and 50 so that the extrusion segments can still be easily joined by means of a length of tubing 38 having continuous outer diameter.

Considerable economies are realized by cutting the various housing segments 12, 14 and 50 from low cost, easily fabricated continuous extrusion tubing. Still more variations in the appearance of the assembled light fixtures can be achieved by varying both the absolute and relative lengths of the various housing segments 12, 14 and 50. Longer or shorter housings 10 can be readily obtained from the same continuous extrusion, simply by varying the lengths of the baffle holder 14 and main housing section 12 without need for costly retooling, by minimal readjustment of production facilities to cut the continuous extrusion to different lengths. Furthermore, the continuous extrusions can be fabricated in an almost limitless variety of exterior shapes, cross-sections and designs without thereby altering the basic construction and advantageous characteristics of this novel light fixture.

From the foregoing, it will be apparent that an attractive and versatile light fixture suitable for modern, high intensity miniature quartz-halogen lamps can be constructed from a minimum number of components which are easily and quickly assembled. While particular embodiments of the invention have been described and illustrated for purposes of clarity and example, it will be readily apparent that many changes substitutions and modifications to the described embodiments can be made by those possessed of ordinary skill in the art without departing thereby from the spirit and scope of the present invention which is limited only by the scope of the following claims.

What is claimed is:

1. A light fixture comprising:

an extruded tubular main segment having two open ends and an axial bore between said ends;

a rear end panel closing one said end of said main segment;

an elongated spacer fixed at one of its ends to said panel and extending axially within said bore;

a lamp socket supported at a free forward end of said spacer;

a reflector mounted on said socket;

an extruded baffle holder segment having a cross-section similar to said main segment; and a coupler tube fixed within one of said segments for joining the two segments by a friction fit while receiving and supporting said reflector against lateral movement within said axial bore;

said reflector being at least partially exterior to said main housing segment upon separation of said baffle holder for facilitating manual replacement of a lamp bulb in said socket.

2. The lamp fixture of claim 1 wherein said axial bore is cylindrical and said extruded main segment has a non-cylindrical outer cross-section.

3. The lamp fixture of claim 1 wherein said spacer, socket, reflector and end panel form a sub-assembly removable together with said end panel upon separation of said end panel from said main segment.

4. The lamp fixture of claim 1 further comprising fixture mounting means including electrical supply conductor means attached to an outer side of said end panel for mounting the fixture to a supporting surface, said supply conductor means passing through an opening in said end panel aligned with said spacer for connection to said socket.

5. The lamp fixture of claim 1 further comprising fixture mounting means including electrical supply conductor means attached to an outer surface of said main segment for mounting the fixture to a supporting surface, said supply conductor means passing through an opening in said main segment and connected to said socket.

6. The lamp of claim 1 wherein said reflector has a circular rim and said coupler tube has an inner diameter slightly greater than the diameter of said reflector rim and further comprising light baffle means in said coupler tube defining a baffle aperture of diameter lesser than said reflector rim.

7. The lamp of claim 1 further comprising an intermediate extruded segment of cross-section common with both said main segment of said baffle holder segment, said intermediate segment being supported on said coupler tube between said main segment and said holder segment, whereby the exterior of said segment, said body and said holder may be of different ornamental combinations of color or texture.

8. The lamp of claim 6 wherein said light baffle means is formed integrally with said coupler tube.

9. A light fixture comprising:

a first extruded tubular segment having two open ends;

a rear end panel removably closing one said end of said body;

an elongated spacer fixed to said panel and extending axially within said bore, said spacer supporting at a free forward end a lamp socket;

a reflector mounted to said socket and having a circular rim;

a second extruded segment having an axial bore of diameter equal to that of said first extruded segment;

a coupler tube of constant outside diameter fixed to said second segment and partly slidable into said axial bore of said first segment for joining said two segments in a friction fit, said coupler tube having an inner diameter slightly greater than said reflector rim for closely receiving said reflector rim and supporting said reflector and socket against radial movement within said axial bore; and light baffle means defining a baffle aperture of lesser diameter than said reflector rim within said coupler tube forwardly of said reflector.

10. The light fixture of claim 9 further comprising fixture mounting means threaded into an opening in said first segment and electrical conductor means entering said first segment through said opening for connection to said socket.

11. The light fixture of claim 9 further comprising fixture mounting means for supporting the fixture to a mounting surface, said exterior mounting means threadingly engaged to a rear end of said elongated spacer through an opening in said end panel with said panel in an interference fit therebetween, and electrical power conductors associated with said mounting means and threaded through said panel opening and spacer for connection to said socket.

12. The lamp of claim 9 further comprising an intermediate extruded segment supported on said coupler tube between said tubular body and said holder, whereby the exterior surfaces of said first, second and intermediate segments may be of different ornamental combinations of color or texture.

13. A light fixture comprising:

a tubular body having two open ends and a continuous bore therebetween;

an end panel removably closing one said end of said body;

an elongated spacer fixed at one of its ends to said panel and extending axially within said body;

a lamp socket supported at a free forward end of said spacer;

a reflector mounted to said socket; and baffle means in a coupler tube insertable into the open forward end of said tubular body for supporting said baffle means to said body in a friction fit with said coupler tube receiving, said coupler tube receiving and supporting said reflector and said socket against lateral movement within said tubular body;

14. The lamp fixture of claim 13 wherein at least a portion of said reflector lies outside said tubular body upon separation of said coupler tube thereby facilitating manual removal of the reflector for replacement of a lamp element in said socket.

15. A light fixture comprising:

a tubular housing having a front end and a rear end and a cylindrical bore therethrough;

a lamp socket within said bore and supported to said housing at said rear end;

a reflector/lamp assembly removably and operatively mounted in said socket, said reflector having a circular rim undersized in relation to said bore; and light baffle means supported to said front end by coupler means including a cylindrical bore continuous with said baffle bore adapted to closely receive said reflector rim and laterally support said exterior reflector within said bore;

whereby said reflector/lamp assembly is readily accessible for replacement of either or both of said reflector and lamp upon separation of said baffle means.

16. A light fixture comprising:

a housing comprised of two or more tubular segments, a fixture mount connected to a first of said segments, said mount including electrical power conductors through said mount and into said first segment;

a coupler tube fixed within a second of said segments and partially extending therefrom;

said extending portion fitted into said first segment for axially joining said first and second segments;

socket means electrically connected to said power conductors;

a lamp/reflector assembly mounted in said socket means and supported within said coupler tube, said reflector having a reflector rim slightly undersized in relation to the inside diameter of said coupler tube such that said reflector/lamp assembly is held against lateral movement within said coupler tube.

17. The fixture of claim 16 further comprising spring clip means supporting said socket means to said coupler tube, said spring clip and socket being removable from said coupler tube upon separation of said first and second segments for replacement of said lamp.

18. The fixture of claim 16 further comprising spacer means supporting said socket means to said first housing segment, said lamp/reflector assembly being exposed for replacement upon separation of said first and second housing segments.

19. A method for making lamp fixtures comprising the steps of:

providing a length of tubing;

cutting first and second segments of said tubing;

securing the rear end of a spacer to a rear end of said first section for supporting said spacer tube axially therein;

mounting a lamp socket and a reflector to the free end of said spacer;

axially joining said two segments by means of an internal coupler tube of internal diameter slightly larger than the rim diameter of the reflector, the coupler tube being partly within each of the two segments and making a frictionally retentive fit with the opposite end of said first segment such that the reflector is closely received within the coupler tube.

20. The method of claim 19 wherein said tubing is continuous extrusion tubing characterized by a cylindrical inner bore slightly oversized to the outer diameter of said coupler tube.

21. A method for making lamp fixtures comprising the steps of:

providing a length of tubing;

cutting first and second segments of said tubing;

fixing an internal coupler tube within one of the two segments such that a portion of said coupler tube extends therefrom;

attaching fixture mounting means to said other segment;

electrically connecting a lamp socket to conductors associated with said fixture mounting means;

fitting a reflector to said lamp socket, said reflector having a rim of diameter slightly smaller than the inside diameter of said coupler tube;

removably mounting said lamp socket and reflector within said coupler tube such that the reflector is closely received within and at least partly supported by the coupler tube; and axially separably joining said two segments by inserting said extending coupler tube portion into one end of the other of said segments in a frictionally retentive fit.

22. The method of claim 21 wherein said step of removably mounting said lamp socket includes the step of attaching said socket to a resilient two-legged mounting clip and engaging the ends of the clip legs into corresponding openings in said coupler tube.

23. A light fixture comprising:

a housing comprised of two or more tubular segments, a fixture mount connected to a first of said segments, said mount including electrical power conductors through said mount and into said first segment;

a coupler tube fixed within a second of said segments and partially extending therefrom;

said extending portion fitted into said first segment for axially joining said first and second segments in a frictional retentive fit;

socket means electrically connected to said power conductors;

a lamp/reflector assembly mounted in said socket means and supported within said coupler tube, said reflector having a reflector rim slightly undersized in relation to the inside diameter of said coupler tube such that said reflector/lamp assembly is held against lateral movement within said coupler tube; and spring clip means supporting said socket means to said coupler tube, said spring clip having two resiliently spreadable legs having leg ends engaged in corresponding openings in said coupler tube such that said socket means is manually removable from said coupler tube upon separation of said first and second segments for replacement of said lamp.

* * * * *